US005498156A

United States Patent [19]

Smith

[11] Patent Number: 5,498,156

[45] Date of Patent: Mar. 12, 1996

[54] DUAL-PURPOSE GUIDE AND DRUM CLEANER FOR STECKEL MILL COILER FURNACE

[75] Inventor: Olan R. Smith, Saskatchewan, Canada

[73] Assignee: Ipsco Enterprises Inc., Wilmington, Del.

[21] Appl. No.: 300,014

[22] Filed: Sep. 2, 1994

[51] Int. Cl.[6] ..... F27D 23/00

[52] U.S. Cl. ..... 432/75; 432/59; 432/8; 432/246; 15/250.21

[58] Field of Search ..... 432/8, 59, 60, 432/75, 228, 246

*Primary Examiner*—Henry A. Bennett

*Assistant Examiner*—Siddharth Ohri

*Attorney, Agent, or Firm*—Robert H. Barrigar; Barrigar & Moss

[57] ABSTRACT

Coiler furnaces of the type used with reversing rolling mills are provided with a strip guide for guiding the leading edge of the incoming steel strip into engagement with the slot in the winding drum of the coiler furnace. According to the present invention, the strip guide is designed as a dual purpose strip guide provided with a cleaning element (e.g. a scraper blade or abrasive element) fixed to the distal end of the strip guide for contacting and cleaning the exterior cylindrical surface of the winding drum when the coiler furnace is otherwise idle.

7 Claims, 4 Drawing Sheets

DUAL-PURPOSE GUIDE AND DRUM CLEANER FOR STECKEL MILL COILER FURNACE

FIELD OF THE INVENTION

The invention relates to coiler furnaces for use with Steckel mills (reversing rolling mills), and in particular to a dual-purpose pivoting guide for use within the coiler furnace that selectably assumes one of three possible positions, viz a rest position out of contact with the coiler furnace drum and the hot strip within the furnace, and two operating positions, viz a drum-cleaning position wherein a cleaning device mounted on or near the distal end of the guide cleans debris from the winding drum of the coiler furnace, and a guiding position in which the guide directs incoming hot strip into engagement with the coiler furnace winding drum.

BACKGROUND TO THE INVENTION

Coiler furnaces used with reversing rolling mills (hereinafter frequently referred to as Steckel mills) require the incoming steel strip to engage the winding drum within the furnace. Upon engagement of the leading edge of the strip with the drum, the strip is coiled within the furnace. To facilitate the engagement of the leading edge of the strip with the receiving slot in the drum, a pivotable guide is conventionally provided within the furnace that is in operating position aligned with the intended path of travel of the incoming strip so that the leading edge of the strip more readily engages the winding drum receiving slot. Once the leading edge of the steel strip has engaged the drum and the drum has begun to wind up the strip within the furnace, the guide pivots out of the way (downwardly) into a rest position out of the way of the coil of strip.

The winding drum of the coiler furnace sometimes accumulates scale and debris that must be cleaned off. To this end, it is conventional practice to place a piece of scrap steel in contact with the winding drum when the coiler furnace is idle, cleaning off the winding drum as required. The procedure is rough and ready, sometimes ineffective, and is hazardous.

SUMMARY OF THE INVENTION

According to my invention, the guide for the incoming strip of steel within the coiler furnace may also be designed to serve as a cleaning element for the coiler furnace winding drum. To this end, I provide in a coiler furnace of the type used in conjunction with a Steckel mill, a strip guide for pivotal mounting about a transverse pivotal axis located in the vicinity of the entrance/exit port of the coiler furnace, suitably modified to double as a cleaning device. The pivotal mounting is per se conventional, permitting the guide to pivot from a rest position at or near the bottom of the coiler furnace into an operating position. However, instead of the single guiding operating position available to conventional guides, my guide may assume a selectable one of two operating positions, namely a strip guiding operating position in which the distal end of the guide is positioned near the surface of the windup drum for the coiler furnace so as to guide the leading edge of incoming steel strip into engagement with the windup drum, and a drum cleaning operating position in which a cleaning element fixed to the guide at or near the distal end of the guide is brought into engagement with or in close proximity to the generally cylindrical surface of the windup drum. For the cleaning operation, the guide is provided with a cleaning or abrading element preferably fixed to the side of the distal end of the guide closest to the cylindrical surface of the windup drum (normally the upper side of the guide), for cleaning the cylindrical surface of the windup drum.

DETAILED DESCRIPTION WITH REFERENCE TO THE DRAWINGS

Figure 1:
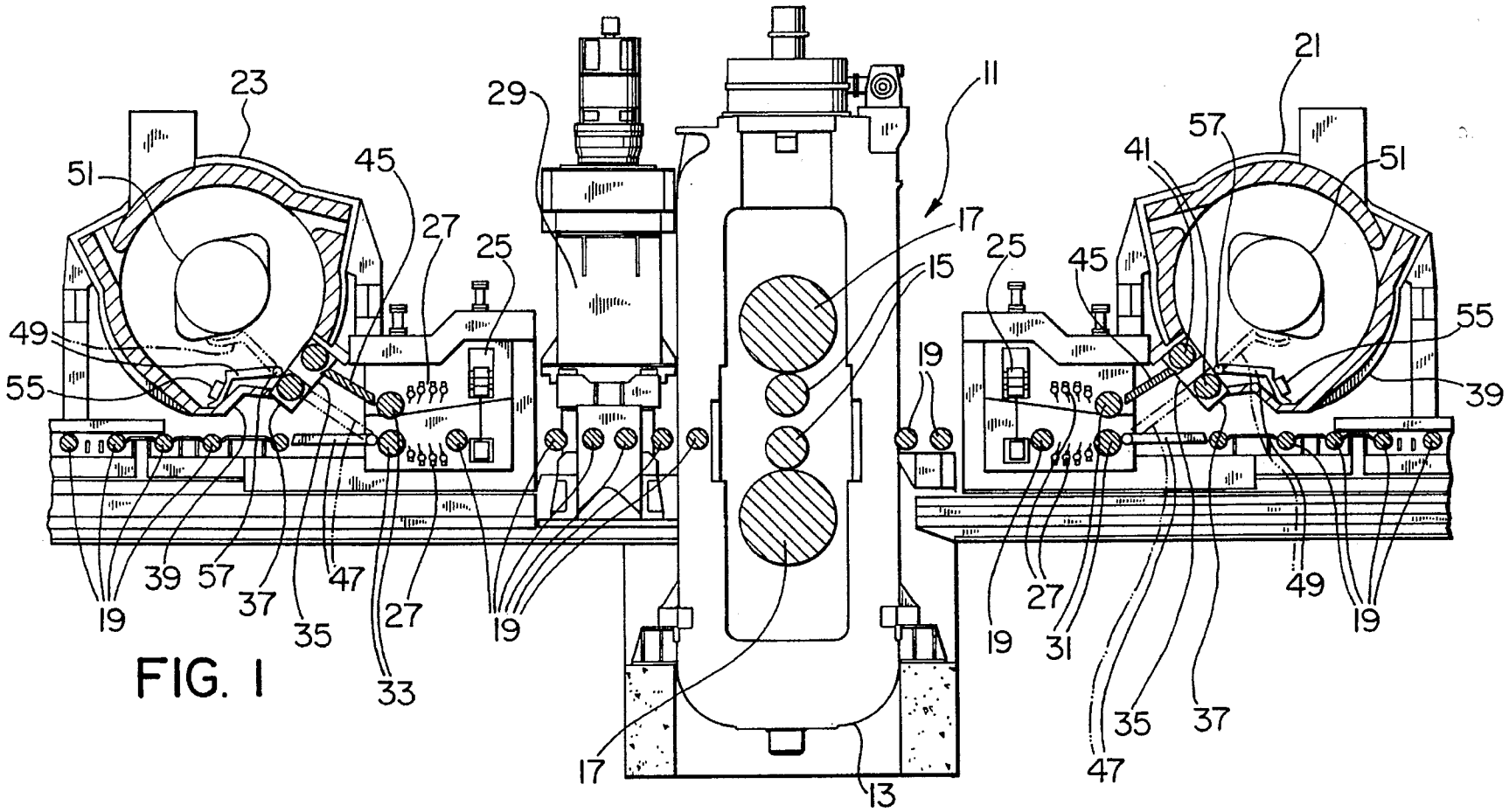
FIG. 1 is a schematic elevation view, partly in section, of a Steckel mill and pair of associated coiler furnaces each including a dual-purpose guide according to the invention.

Referring to FIG. 1, a Steckel mill generally indicated as 11 is provided with a frame 13 in which a pair of reducing work rolls 15 and associated back-up rolls 17 are rotatably mounted. Table rolls 19 positioned as required drivingly support the slab or strip of steel being rolled, both upstream and downstream of the Steckel mill.

An upstream coiler furnace 21 and a downstream coiler furnace 23 are located immediately upstream and immediately downstream respectively of the Steckel mill 11 within the limits imposed by the need to interpose some items of associated mill equipment between the Steckel mill 11 and each of the coiler furnaces 21 and 23. Illustrated by way of example are x-ray gauges 25, spray nozzles 27, a downstream edger 29, and unheated pinch rolls, the upstream pair of unheated pinch rolls being designated as 31 and the downstream pair designated as 33.

At the entrance/exit port generally indicated as 35 for each of the coiler furnaces 21, 23, is a hooded collar 37 forming a continuum with the wall 39 of each of the coiler furnaces 21, 23. Heated pinch roll pairs 41, 43 are provided within hooded collar 37 to enable maximum retraction of the steel strip within the respective coiler furnace 21, 23. Located between the pairs of unheated pinch rolls 31, 33 and the entrance/exit ports are fixed upper shields 45 and pivoting lower gate extensions 47. The upper shields 45 and lower gate extensions 47 are arranged to span as much as possible of the distance between the roll pairs 31, 33 and the entrance/exit ports 35 so as to minimize heat loss of the strip as it passes between the unheated pinch rolls 31, 33 and the entrance/exit ports.

The gate extension 47 must be able to pivot out of the way when a slab or strip too thick to be coiled in the coiler furnace is being rolled and must pass underneath the coiler furnace. Also, the downstream gate extension 47 must be able to pivot out of the way on the last pass so that the strip may be fed to any further downstream processors (not shown) and eventually to a downcoiler (not shown) for coiling the strip for shipment. In FIG. 1, each of the gate extensions 47 is shown in its lowermost position in solid lines (permitting strip or slab to pass freely underneath the associated coiler furnace 21 or 23) and, in its elevated position, in broken lines. The broken-line position is the position that the gate extension 47 would occupy when sheet is being paid into or out of the associated coiler furnace 21, 23, as the case may be.

Figure 2A:
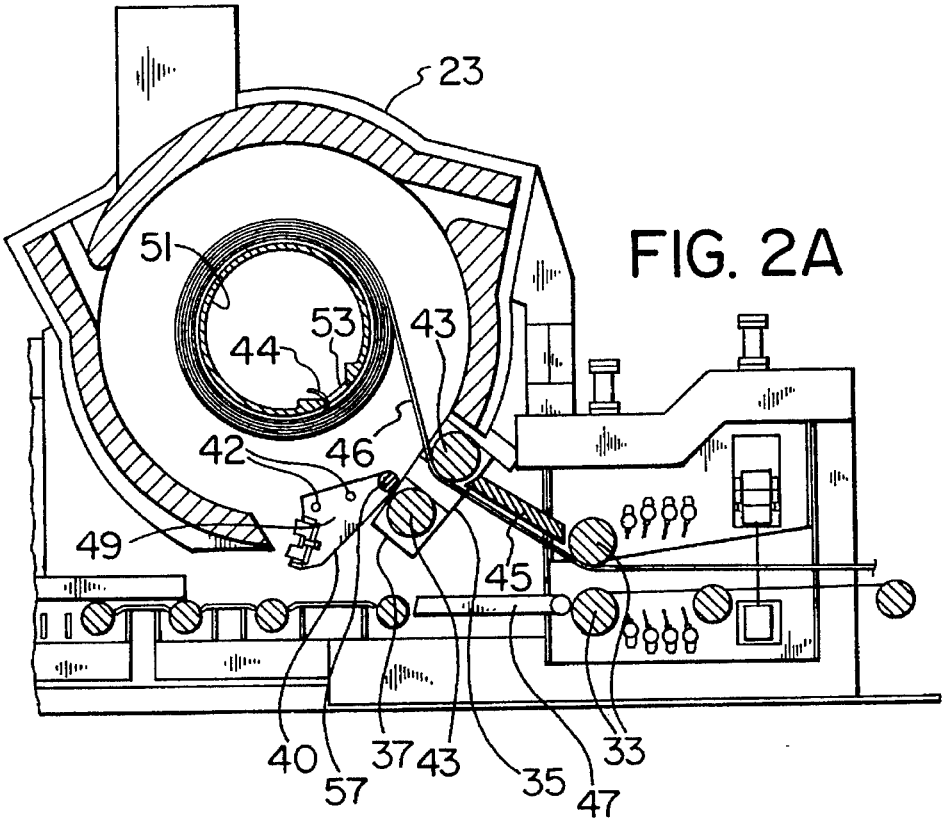
FIG. 2A is a schematic elevation view, partly in section, of a coiler furnace having a dual-purpose guide according to the invention, the guide being shown in rest position.
Figure 2B:
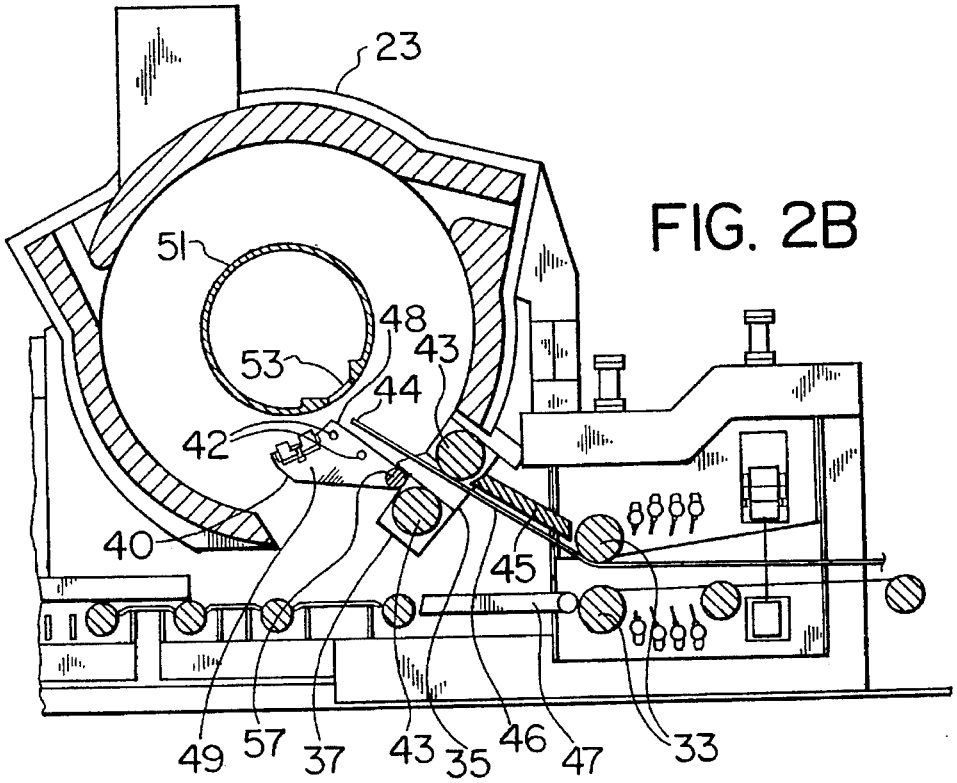
FIG. 2B is a schematic elevation view, partly in section, of a coiler furnace with the guide of FIG. 2A in guiding operating position, for guiding steel strip into engagement with the windup drum.
Figure 2C:
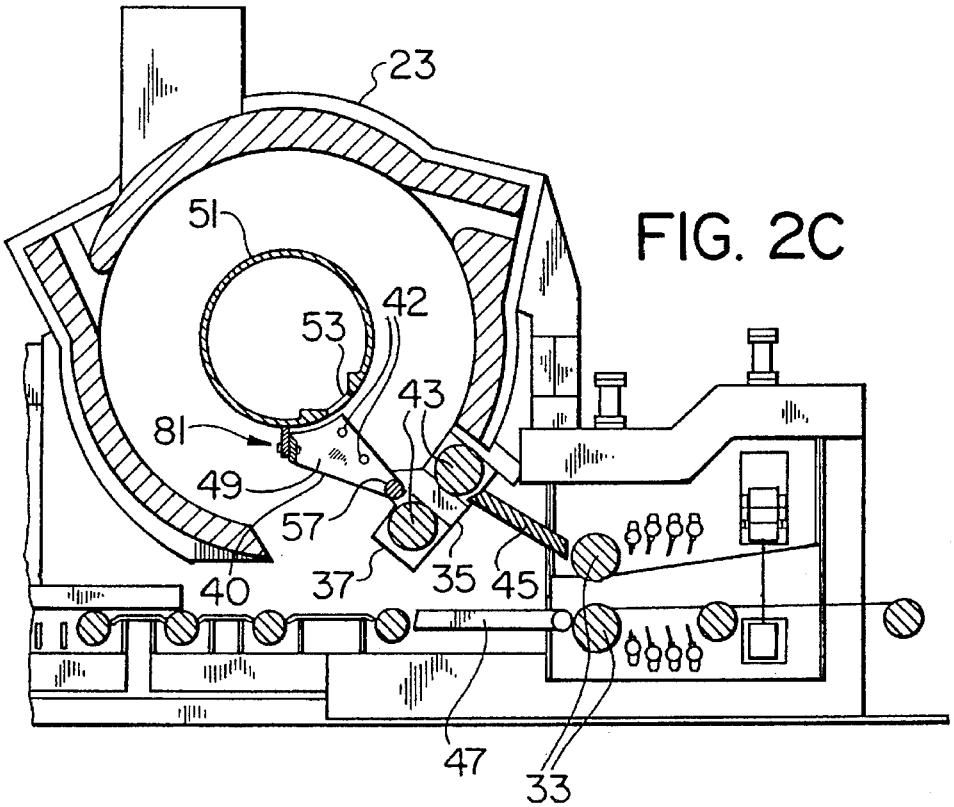
FIG. 2C is a schematic elevation view, partly in section, of a coiler furnace with a scraper-type guide according to the invention, shown in cleaning operating position, for cleaning the windup drum.

Much of the detail shown in FIG. 1 is for purposes of describing a typical Steckel mill environment of current design, rather than per se describing the present invention. FIGS. 2A, 2B, 2C illustrate the three positions of the dual-purpose guide according to the invention with reference to coiler furnace 23; it is to be understood that the mirror image of the illustrated arrangement would also be found in coiler furnace 21.

Within each of the coiler furnaces 21 and 23, there is a pivotally mounted guide 49, mounted on a pivot pin 57, whose primary function is to guide the incoming leading edge 44 of the strip 46 (FIG. 2B) to be coiled into an engagement slot (not shown in FIG. 1; see slot 53 in FIGS. 2A, 2B, 2C) in the winding drum 51, whereupon the drum 51 coils the strip 46 around itself, winding it up within the associated coiler furnace 21 or 23. The guide 49 is of conventional construction except for its dual purpose use as described herein, which includes the addition of a cleaning element of the general type illustrated in FIGS. 3A and 3B, to be described in further detail below. Pins 42 engaging mating holes in the end pieces 40 of guide 49 hold in place a transverse bar (not shown) of conventional design for guiding the strip 46 toward drum 51. To carry out this guiding function, guide 49 is placed in the operating position shown in FIG. 2B, with the distal end 48 of the guide 49 positioned near the surface of the winding drum 51.

For schematic clarity, the strip 46 in FIG. 2A is not shown to be in contact with both the upper and lower pinch rolls in each set 33, 43. However, of course in actual practice, both upper and lower pinch rolls in each set 33, 43 would engage and drive the strip 46.

Once the winding of strip 46 has begun, the guide 49 drops out of the way, into the rest position shown in FIG. 2A, by pivoting downward about pivot pin 57. When the strip 46 is wound on drum 51, the outermost coil radius within the coiler furnace is kept sufficiently small that it does not contact guide 49 in the rest position. Guide 49 remains in the rest position when the strip is uncoiled from drum 51 and paid out of the coiler furnace 23, so guide 49 does not interfere with the progress of the strip out of the entrance/exit port 35.

As shown in FIG. 1, an abrading cleaning element 55 is affixed to the distal end of guide 49. The element 55 has a concave surface on its side closest to the drum 51. The concave surface has a radius of curvature substantially the same as that of the drum 51. The element 55 is made, for example, of abrasive refractory material and is bolted to guide 49. The bolts are countersunk in the cleaning and abrading element 55 so the bolt heads do not project above its concave surface.

To clean the drum 51, the guide 49 is pivoted upwardly into the cleaning position shown in broken lines in FIG. 1 such that the concave surface of the cleaning element 55 rubs against the outer cylindrical surface of the drum 51, whereby it can knock off scale or debris clinging to the drum's surface, as the drum 51 is rotated.

Figure 3A:
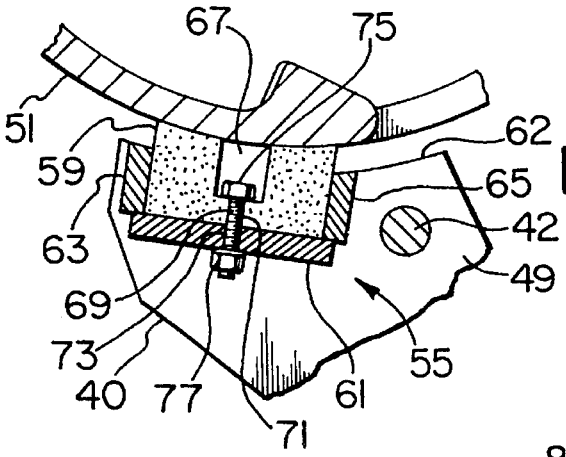
FIG. 3A is a schematic elevation view, partly in section, of an abrasive cleaning element suitable for use with the guide of FIGS. 2A and 2B.
Figure 3B:
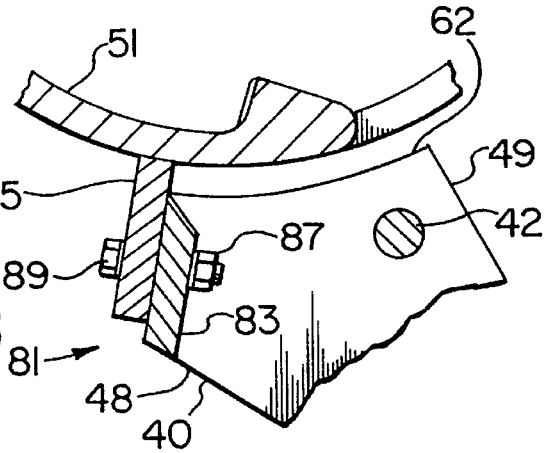
FIG. 3B is a schematic elevation view, partly in section, of a scraper cleaning element suitable for use with the guide of FIG. 2C.

The cleaning element 55 of FIG. 1 is an abrasive-type cleaning element and is illustrated also in FIGS. 2A, 2B and in greater detail in FIG. 3A. A consumable abrasive stone 59 is secured within a channel formed by a base bar or slate 61 and side bars 63 and 65. An elongated central cavity 67 permits a transversely spaced array of bolts 69 to be mounted, passing through appropriate holes 71, 73 in the abrasive element 59 and base plate 61 respectively. The head 75 of each bolt 69 maintains such bolt 69 in position relative to consumable abrasive element 59. A nut 77 exterior to and at the bottom of the base plate 61 firmly secures the consumable abrasive element 59 to the base plate 61. Base plate 61 and side plates 63 and 65 are welded to or otherwise secured in the dual purpose guide 49.

As an alternative to the abrasive cleaning element of FIGS. 1, 2A, 2B and 3A, a scraper type cleaning element can be used instead. Such scraper type cleaning element 81 is illustrated in FIG. 2C and in more detail in FIG. 3B. At the distal end 48 of the dual purpose guide 49 is a mounting bracket 83 to which a consumable scraper blade 85 is fixed by means of a transversely spaced series of nuts 87 and bolts 89 passing through mating holes in the consumable scraper blade 85 and the support bracket 83. The scraper blade 85 should be made of relatively hard high-strength steel.

When the consumable abrading element 59 or the consumable scraper blade 85, as the case may be, has been eroded to the point at which its uppermost surface is roughly coincident with the upper concave surface 62 of the dual purpose guide 49, the spent cleaning element may be removed by detaching the nuts from the bolts that fix it in place, and a fresh cleaning element inserted as a replacement.

The dual purpose guide 49 is positioned in the intended one of the three positions illustrated in FIGS. 2A, 2B and 2C by means of pivoting torque applied to pivot pin 57 to which dual purpose guide 49 is fixed. In the cleaning position illustrated in FIG. 2C, preferably some continuing torque is applied to pin 57 so that the dual purpose guide 49 is biased into contact with the periphery of winding drum 51. Torque may be applied to the pivot pin 57 by means of a crank and hydraulic piston/cylinder arrangement or otherwise in accordance with the designer's preference. It is preferred that if a hydraulic piston/cylinder arrangement is used, there be proportional pressure control for biasing the guide 49 into cleaning contact with the drum 51 when operating in cleaning mode.

Figure 4:
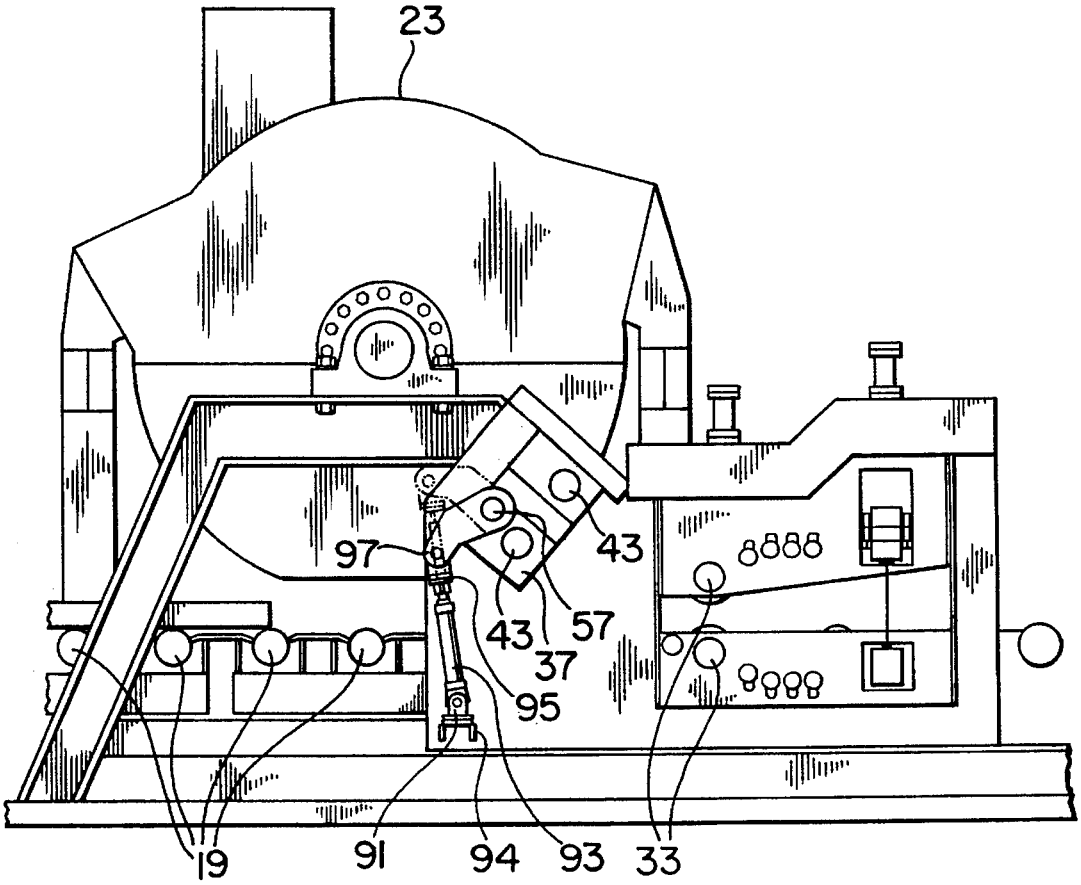
FIG. 4 is a schematic side elevation view of the exterior of a coiler furnace having a dual-purpose guide according to the invention, the guide being shown both in rest position (solid line) and in cleaning position (broken line).

The side elevation view of the exterior of the downstream coiler furnace 23 shown in FIG. 4 illustrates a means for adjusting the angular position of the pivot pin 57 (and thus of the guide 49) and for applying pivoting torque to pivot pin 57, viz a crank arm 97 and hydraulic piston 95 and associated cylinder 93 pivotally mounted by means of a mounting bracket 91 to a transverse beam 94 fixed to the coiler furnace 23. The position of the crank arm 97 shown in solid line corresponds to the rest position illustrated in FIG. 2, while the broken line position of crank arm 97 position corresponds to the cleaning position shown in FIG. 2C. The guiding position shown in FIG. 2B corresponds to a position intermediate the solid line and the broken line positions of the crank 97.

It will be apparent to a person skilled in the art that variants in the design can be used in lieu of those described above for the preferred embodiment. Various alternative means can be employed for attaching the cleaning and abrading element to the guide, such as a mating slot and ridge configuration on the guide and element, whereby the element can be slid and locked into place on the guide. These and other variants are within the scope of the invention, which is defined in the appended claims.

What is claimed is:

1. In a coiler furnace of the type used in conjunction with a reversing rolling mill, said furnace having a transversely rotatably mounted winding drum for steel strip to be coiled within the furnace and an entrance/exit port for passage of steel strip into or out of the coiler furnace;

a dual-purpose strip guide provided with a cleaning element fixed thereto for cleaning the exterior cylindrical surface of the winding drum when the cleaning element is brought into engagement with scale or debris on the said surface; said guide being pivotally mounted about a transverse pivotal axis located in the vicinity of the entrance/exit port of the coiler furnace, thereby permitting the guide to pivot from a rest position at the bottom of the coiler furnace out of the way of the steel strip wound upon the winding drum into a selectable one of two operating positions, namely a strip guiding operating position in which the distal end of the guide relative to the pivotal axis is positioned adjacent the surface of the winding drum for the coiler furnace so as to guide the leading edge of incoming steel strip into engagement with the winding drum, and a drum cleaning operating position in which the cleaning element fixed to the guide is brought into engagement with scale or debris on the exterior cylindrical surface of the winding drum.

2. A strip guide as defined in claim 1, wherein the cleaning element is fixed to the guide at or near the distal end of the guide relative to the pivotal axis thereof.

3. A strip guide as defined in claim 2, wherein the guide and cleaning element span substantially the entirety of the axial length of the winding drum.

4. A strip guide as defined in claim 2, wherein the cleaning element is made of abrasive material.

5. A strip guide as defined in claim 2, wherein the cleaning element is a scraper.

6. A strip guide as defined in claim 3 in combination with means associated therewith for selectably positioning the strip guide in a rest position, a guiding position, and a cleaning position.

7. The combination of claim 6, wherein said positioning means is controllable to apply a torque to the strip guide when in cleaning position thereby to bias the strip guide into cleaning engagement with the winding drum.

* * * * *